US009177742B2

(12) United States Patent
Ache et al.

(10) Patent No.: US 9,177,742 B2
(45) Date of Patent: Nov. 3, 2015

(54) MODULAR SOLID DIELECTRIC SWITCHGEAR

(75) Inventors: Janet Ache, Oak Lawn, IL (US); William Weizhong Chen, Munster, IN (US); Kennedy Amoako Darko, Bolingbrook, IL (US); Donald Richard Martin, New Lenox, IL (US); Nenad Uzelac, St. John, IN (US)

(73) Assignee: G & W ELECTRIC COMPANY, Blue Island, IL (US)

( * ) Notice: Subject to any disclaimer, the term of this patent is extended or adjusted under 35 U.S.C. 154(b) by 436 days.

(21) Appl. No.: 13/275,570

(22) Filed: Oct. 18, 2011

(65) Prior Publication Data

US 2013/0092658 A1 Apr. 18, 2013

(51) Int. Cl.

| | |
|---|---|
| ***H01H 33/42*** | (2006.01) |
| ***H01H 33/662*** | (2006.01) |
| *H01H 33/24* | (2006.01) |
| *H01H 33/66* | (2006.01) |

(52) U.S. Cl.

CPC ..... *H01H 33/66207* (2013.01); *H01H 33/24* (2013.01); *H01H 33/6606* (2013.01); *H01H 2033/6623* (2013.01); *Y10T 29/49105* (2015.01)

(58) Field of Classification Search

CPC ..... H01H 2033/6667; H01H 33/42; H01H 33/666

USPC ..... 218/152

See application file for complete search history.

(56) References Cited

U.S. PATENT DOCUMENTS

| | | | | |
|---|---|---|---|---|
| 3,123,698 A | | 3/1964 | Waterton | |
| 4,150,270 A | * | 4/1979 | Zunick | 218/138 |
| 4,568,804 A | * | 2/1986 | Luehring | 218/138 |
| 4,748,304 A | | 5/1988 | Soboul | |
| 5,170,885 A | | 12/1992 | Guenther et al. | |

(Continued)

FOREIGN PATENT DOCUMENTS

| | | |
|---|---|---|
| EP | 1119009 | 7/2001 |
| JP | 11113118 | 4/1999 |

(Continued)

OTHER PUBLICATIONS

"Elastimold Product Selection Guide" Thomas & Betts Corporation (2009).

(Continued)

*Primary Examiner* — Truc Nguyen

(74) *Attorney, Agent, or Firm* — Michael Best & Friedrich

(57) ABSTRACT

Modular switchgear and methods for manufacturing the same. The modular switchgear includes a vacuum interrupter assembly, a source conductor assembly, and a housing assembly. The vacuum interrupter assembly includes a bushing, a fitting, and a vacuum interrupter at least partially molded within the bushing and including a movable contact and a stationary contact. The source conductor assembly includes a bushing, a fitting, and a source conductor molded within the bushing. The housing assembly includes a housing defining a chamber and a drive shaft and conductor positioned within the chamber. The housing assembly also includes a first receptacle for receiving the fitting of the vacuum interrupter assembly and a second receptacle for receiving the fitting of the source conductor assembly. The vacuum interrupter assembly, the source conductor assembly, and the housing assembly are coupled without molding the assemblies within a common housing.

53 Claims, 9 Drawing Sheets

(56) References Cited

U.S. PATENT DOCUMENTS

| | | | | |
|---|---|---|---|---|
| 5,387,772 | A * | 2/1995 | Bestel | 218/118 |
| 5,521,348 | A | 5/1996 | Berndt et al. | |
| 5,528,009 | A | 6/1996 | Marquardt et al. | |
| 5,729,888 | A | 3/1998 | Abdelgawad et al. | |
| 5,747,765 | A | 5/1998 | Bestel et al. | |
| 5,808,258 | A | 9/1998 | Luzzi | |
| 5,912,604 | A | 6/1999 | Harvey et al. | |
| 5,917,167 | A * | 6/1999 | Bestel | 218/138 |
| 6,107,592 | A | 8/2000 | Morita et al. | |
| 6,111,212 | A | 8/2000 | DuPont et al. | |
| 6,130,394 | A | 10/2000 | Hogl | |
| 6,172,317 | B1 | 1/2001 | Wristen | |
| 6,198,062 | B1 * | 3/2001 | Mather et al. | 218/152 |
| 6,242,708 | B1 | 6/2001 | Marchand et al. | |
| 6,268,579 | B1 | 7/2001 | Kajiwara et al. | |
| 6,310,310 | B1 | 10/2001 | Wristen | |
| 6,326,872 | B1 | 12/2001 | Marchand et al. | |
| 6,362,445 | B1 | 3/2002 | Marchand et al. | |
| 6,373,358 | B1 | 4/2002 | Davies et al. | |
| 6,529,009 | B2 | 3/2003 | Kikukawa et al. | |
| 6,723,940 | B1 | 4/2004 | Book et al. | |
| 6,747,234 | B2 | 6/2004 | Traska et al. | |
| 6,828,521 | B2 | 12/2004 | Stoving et al. | |
| 6,888,086 | B2 | 5/2005 | Daharsh et al. | |
| 6,897,396 | B2 | 5/2005 | Ito et al. | |
| 6,927,356 | B2 | 8/2005 | Sato et al. | |
| 7,148,441 | B2 | 12/2006 | Daharsh et al. | |
| 7,244,903 | B2 | 7/2007 | Utsumi et al. | |
| 7,304,262 | B2 | 12/2007 | Stoving et al. | |
| 7,492,062 | B1 | 2/2009 | Wristen et al. | |
| 7,754,992 | B2 * | 7/2010 | Stepniak et al. | 218/146 |
| 7,887,732 | B2 * | 2/2011 | Daharsh et al. | 264/261 |
| 2002/0043515 | A1 | 4/2002 | Kajiwara et al. | |
| 2002/0043516 | A1 | 4/2002 | Morita et al. | |
| 2004/0061589 | A1 | 4/2004 | Daharsh et al. | |
| 2007/0228014 | A1 | 10/2007 | Tsuchiya et al. | |
| 2009/0119899 | A1 | 5/2009 | Muench et al. | |
| 2009/0200270 | A1 | 8/2009 | Chen | |
| 2009/0218319 | A1 | 9/2009 | Kagawa | |
| 2010/0038343 | A1 | 2/2010 | Sato et al. | |
| 2010/0059480 | A1 | 3/2010 | Sasaki et al. | |
| 2010/0276395 | A1 | 11/2010 | Gardner | |

FOREIGN PATENT DOCUMENTS

| | | |
|---|---|---|
| JP | 2005005277 | 1/2005 |
| KR | 100848123 | 7/2008 |
| WO | 00/21104 | 4/2000 |
| WO | 03/081737 | 10/2003 |
| WO | 2006/111479 | 10/2006 |

OTHER PUBLICATIONS

Cooper Power Systems, Inc., "Reclosers," maintenance instructions (Jun. 1991) Retrieved from the internet on 2012-11-202 from URL http://www.cooperindustries.com/content/dam/public/powersystems/resources/library/280_ReclosersControls/S280455.PDF> pp. 3, 9, Fig. 8, Pittsburgh.

PCTUS2012050813 International Search Report and Written Opinion mailed on Oct. 26, 2012, 16 pages.

* cited by examiner

MODULAR SOLID DIELECTRIC SWITCHGEAR

BACKGROUND

Solid dielectric switchgear typically includes a source conductor and a vacuum interrupter with at least one stationary contact and at least one movable contact. Switchgear also includes a contact-moving mechanism for moving the movable contact included in the vacuum interrupter and an operating rod (e.g., a drive shaft) that connects the mechanism to the movable contact. In addition, switchgear can include one or more sensors, such as a current sensor, a current transformer, or voltage sensor. All of these components are commonly over-molded in a single epoxy form. Therefore, the vacuum interrupter, contact-moving mechanism, operating rod, and any sensors are molded within a single coating or layer of epoxy to form integrated switchgear.

The single epoxy form provides structural integrity and dielectric integrity. In particular, the components of the switchgear are over-molded with epoxy that has high dielectric strength. The molded epoxy also can be formed into skirts on the outside of the switchgear that increase the external creep distance. The single epoxy form also protects against environment elements.

SUMMARY

There are many issues, however, related to integrated switchgear. First, over-molding the switchgear as one part poses manufacturing challenges. In particular, molding over multiple components increases the risk of forming voids. Voids reduce electrical integrity by creating air pockets that may become charged. Voids can lead to coronal discharge and voltage stress that shortens the life of the switchgear.

In addition, when all of the components are tied together in one integrated module, the complexity of the switchgear is increased. For example, if an area within the switchgear is not over-molded properly, the entire switchgear may be unusable. The over-molding also limits the flexibility of the switchgear design. For example, if switchgear is needed that has specific requirements (e.g., voltage rating, sensor requirements, etc.), a completely new design is needed for the integrated switchgear even if just one component is changed.

Also, integrated switchgear is typically grounded and connected to a metal tank or housing assembly that holds operating mechanisms for the switchgear. The creep distance of the switchgear, however, is measured from the high voltage areas of the switchgear to the metal housing assembly. Therefore, the size of the switchgear must be designed to allow for the proper creep distance between the metal housing assembly and the high voltage areas. In general, this requires that the switchgear be larger to provide a proper creep distance.

Similarly, integrated switchgear also provides an area for the operating rod to function while providing an internal creep distance to the contact-moving mechanism. Without space to place skirts, the creep distance needed increases the height requirements of the switchgear. The operating rod also defines a creep distance over its surface to the contact-moving mechanism. To increase this creep distance, horizontal ribs are sometimes placed along the operating rod. However, adding these ribs often increases the height of the switchgear.

As described above, the integrated switchgear includes a vacuum interrupter. A vacuum interrupter includes a ceramic bottle with two contacts vacuum-sealed inside the bottle. Fault interruption is performed in the vacuum. However, the contacts must have enough holding force so that the contacts do not weld together during a short circuit interruption. The need for a strong holding force creates challenges for the design of the contact-moving mechanism that operates the vacuum interrupter, which leads to complicated and expensive mechanism design. Additionally, to achieve a high mechanical life, a dampening system is used, which adds cost and complexity to the switchgear.

When a current transformer is included in the switchgear, it can be molded into the single-form epoxy of the integrated switchgear or can be externally mounted on the epoxy. Typically, wires are then attached between the current transformer and monitoring equipment. However, attaching external wires to the current transformer creates additional manufacturing challenges during final assembly of the switchgear.

Accordingly, embodiments of the invention provide non-integrated switchgear that is, in general, lower-cost and easier-to-manufacture and increases design flexibility, reduces production scrap, and improves serviceability. For example, a modular design can be used that reduces manufacturing challenges (e.g., risk of void formation) and increases design flexibility. In addition or alternatively, the housing assembly can be separately molded from the vacuum interrupter and source conductor. A plastic housing assembly can then be used that provides more external over surface distance from line to ground. The housing assembly can house the operating rod and provide the needed internal electrical creep distance. In some constructions, the housing assembly can include internal skirts to provide additional creep distance. Also, the operating rod can include vertical skirts to minimize the overall height of the switchgear while maximizing internal creep distance. Furthermore, a flexible conductor that connects in series with the vacuum interrupter can be used to provide more holding force for the vacuum interrupter during current interruptions. The flexible conductor, therefore, can allow for lighter and less expensive mechanisms and can provide dampening to increase the mechanical life of the switchgear. In addition, a current transformer can be molded into a portion of the switchgear and can include a molded connector to simplify wiring assembly.

In one construction, the invention provides modular switchgear. The modular switchgear includes a vacuum interrupter assembly, a source conductor assembly, and a housing assembly. The vacuum interrupter assembly has a first end and a second end and includes a bushing, a vacuum interrupter including a movable contact and a stationary contact and at least partially molded within the bushing, and a fitting positioned adjacent to the second end. The source conductor assembly has a first end and a second end and includes a bushing, a source conductor molded within the bushing, and a fitting positioned adjacent the second end. The housing assembly includes a housing defining a chamber, a drive shaft positioned within the chamber and configured to interact with the movable contact included in the vacuum interrupter, a conductor positioned within the chamber and configured to electrically couple the vacuum interrupter and the source conductor, a first receptacle for receiving the fitting of the vacuum interrupter assembly, and a second receptacle for receiving the fitting of the source conductor assembly. The vacuum interrupter assembly, the source conductor assembly, and the housing assembly are coupled without molding the assemblies within a common housing.

In another construction, the invention provides a method of manufacturing switchgear. The method includes providing a vacuum interrupter assembly including a vacuum interrupter molded within a bushing and including a fitting, the vacuum interrupter including a movable contact and a stationary contact; providing a source conductor assembly including a source conductor molded within a bushing and including a fitting; and providing a housing assembly including a drive shaft configured to couple to the movable contact, a conductor configured to electrically couple the vacuum interrupter and the source conductor, a first receptacle for receiving the fitting of the vacuum interrupter assembly, and a second receptacle for receiving the fitting of the source conductor assembly. The method also includes coupling the vacuum interrupter assembly to the housing assembly using the fitting of the vacuum interrupter assembly and the first receptacle without molding the vacuum interrupter assembly and the housing assembly within a common housing and coupling the source conductor assembly to the housing assembly using the fitting of the source conductor assembly and the second receptacle without molding the source conductor assembly and the housing assembly within a common housing.

In still another construction, the invention provides a vacuum interrupter assembly for modular switchgear. The vacuum interrupter assembly has a first end and second end and includes a bushing, a vacuum interrupter having a movable contact and a stationary contact and molded within the bushing, and a fitting positioned adjacent to the second end configured to couple the vacuum interrupter assembly to a receptacle on a housing assembly. The housing assembly includes a drive shaft configured to interact with the movable contact and a conductor configured to electrically couple the vacuum interrupter and a source conductor. The vacuum interrupter assembly is coupled to the housing assembly without molding the vacuum interrupter assembly and the housing assembly in a common housing.

In yet another construction, the invention provides a source conductor assembly for modular switchgear. The source conductor assembly has a first end and second end and includes a bushing, a source conductor molded within the bushing, and a fitting positioned adjacent the second end configured to couple the source conductor assembly to a receptacle on a housing assembly, the housing assembly including a drive shaft configured to interact with a vacuum interrupter and a conductor configured to electrically couple the source conductor and the vacuum interrupter. The source conductor assembly is coupled to the operating housing without molding the source conductor assembly and the housing assembly in a common housing.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
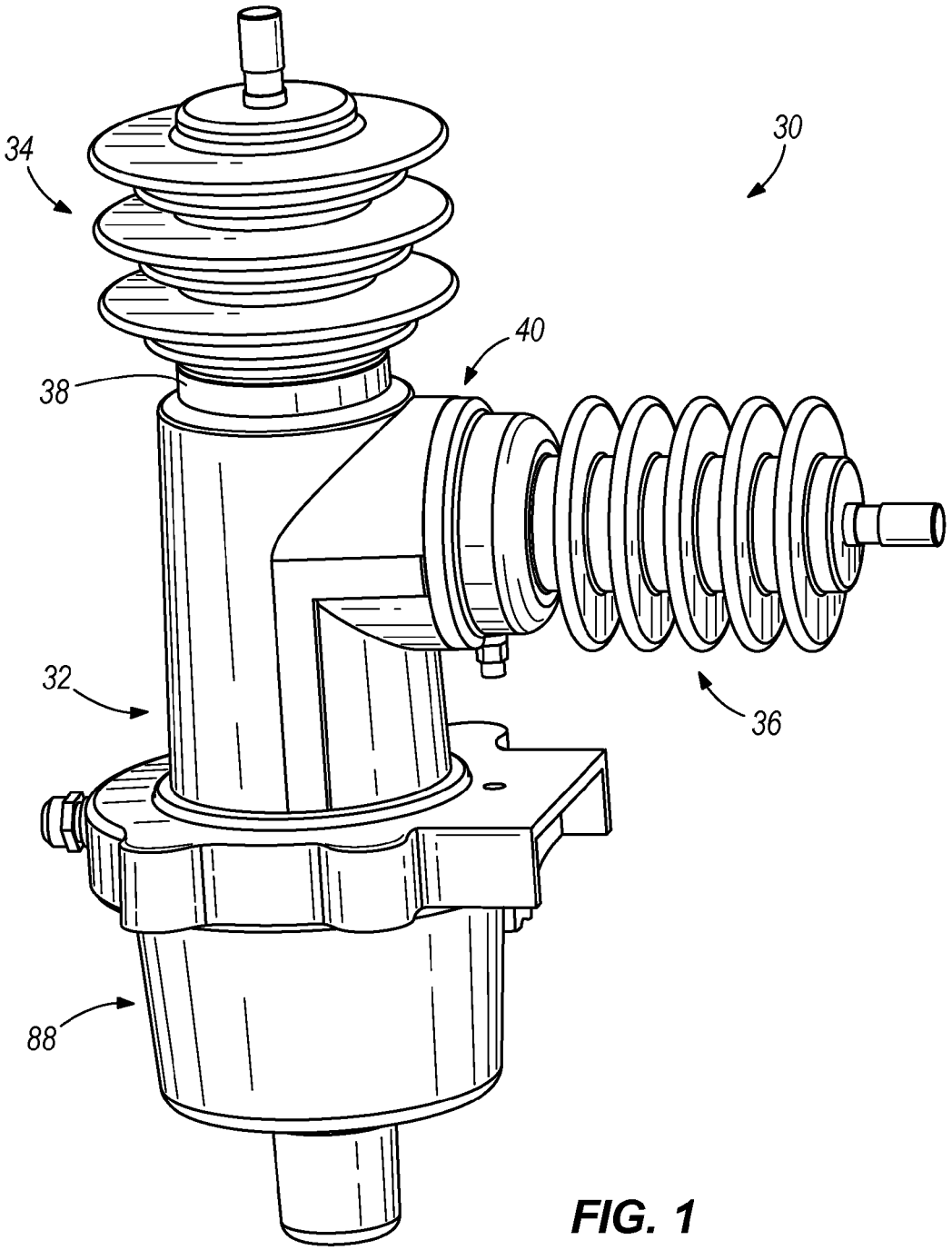
FIG. 1 is a perspective view of modular switchgear according to one embodiment of the invention.
Figure 2:
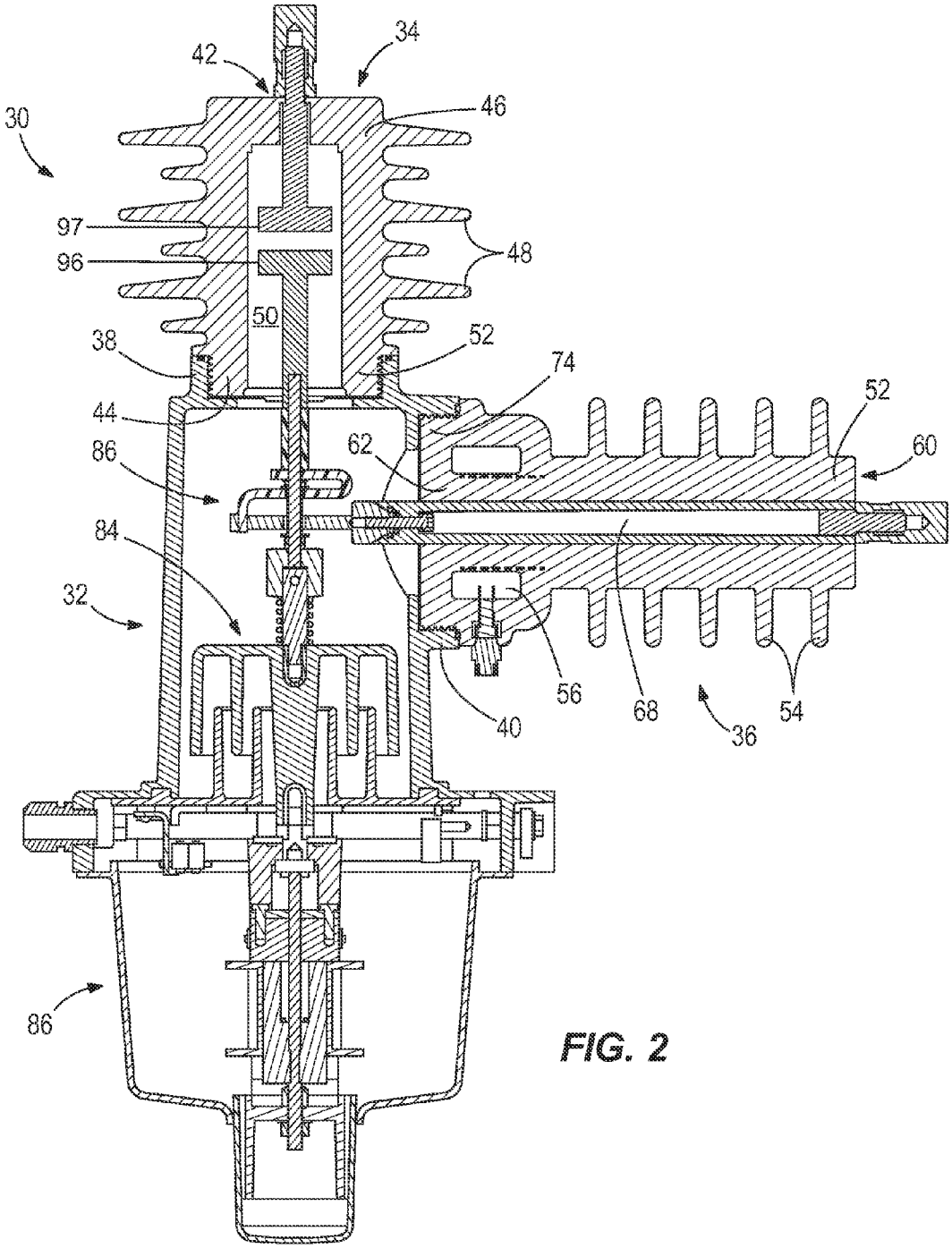
FIG. 2 is a cross-sectional view of the modular switchgear of FIG. 1.
Figure 3:
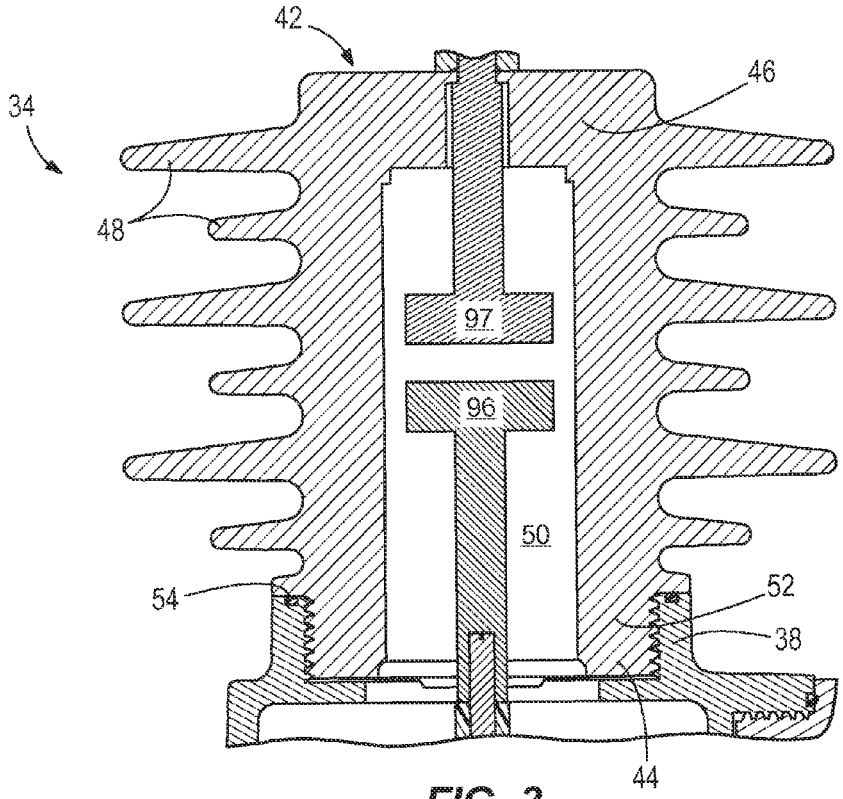
FIG. 3 is a cross-sectional view of a vacuum interrupter of the modular switchgear of FIG. 1.

FIGS. 1 and 2 illustrate modular switchgear 30 according to one embodiment of the invention. The modular switchgear 30 includes a housing assembly 32, a vacuum interrupter ("VI") assembly 34, and a source conductor assembly 36. The housing assembly 32 includes a first receptacle 38 for receiving the VI assembly 34 and a second receptacle 40 for receiving the source conductor assembly 36. The VI assembly 34 has a first end 42 and a second end 44 and includes a bushing 46 (see FIGS. 2 and 3). The bushing 46 is constructed from an insulating material, such as epoxy, that forms a solid dielectric. For example, the bushing 46 can be constructed from a silicone or cycloaliphatic epoxy or a fiberglass molding compound. The bushing 46 withstands heavily polluted environments and serves as a dielectric material for the switchgear 30. As shown in FIG. 3, the bushing 46 includes skirts 48 along the outer perimeter.

The VI assembly 34 also includes a VI 50 at least partially molded within the bushing 46. The VI 50 includes a movable contact 96 and a stationary contact 97. The movable contact 96 is movable to establish or break contact with the stationary contact 97. Therefore, the movable contact 96 can be moved to establish or break a current path through the switchgear 30.

The VI assembly 34 also includes a fitting 52 positioned adjacent to the second end 38. The first receptacle 38 of the housing assembly 32 receives the fitting 52. For example, as shown in FIG. 3, the fitting 52 and the first receptacle 38 include mating threads that allow the VI assembly 34 to be screwed into the housing assembly 32. A gasket 54 is placed between at least a portion of the fitting 52 and the first receptacle 38 and is compressed when the VI assembly 34 is coupled to the housing assembly 32. The gasket 54 prevents moisture and other contaminants from collecting within the fitting 52 and the first receptacle 38 and entering the VI assembly 34 or the housing assembly 32. The fitting 52 and the first receptacle 38 can also be configured to form other types of mechanical couplings between the housing assembly 32 and the VI assembly 34, such as a snap-fit coupling, a friction coupling, or an adhesive coupling.

Figure 4:
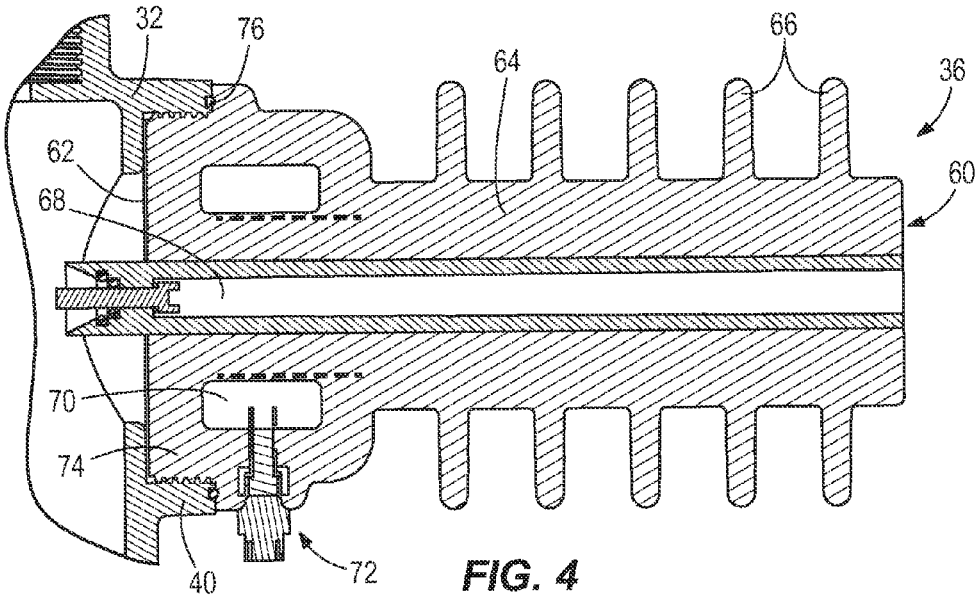
FIG. 4 is a cross-sectional view of a source conductor of the modular switchgear of FIG. 1.

The source conductor assembly 36 is also coupled to the housing assembly 32. As shown in FIG. 4, the source conductor assembly 36 has a first end 60 and a second end 62 and includes a bushing 64. The bushing 64 is constructed from an insulating material, such as epoxy, that forms a solid dielectric. The bushing 64 also includes skirts 66 along the outer perimeter. It should be understood that the bushing 64 can be constructed from the same type of insulating material as the bushing 46 or can be different to provide different insulation properties. The source conductor assembly 36 also includes a source conductor 68 at least partially molded within the bushing 64. The source conductor 68 is electrically coupled to a high-power system (not shown) and provides a current path from the VI 50 to the high-power system.

In addition, the source conductor assembly 36 includes a sensor assembly 70. The sensor assembly 70 can include a current transformer, a voltage sensor, or both. As described in further detail below with respect to FIGS. 10-11, the source conductor assembly 36 can also include a connector 72. The connector 72 is coupled to the sensor assembly 70 and includes a portion that is exposed outside the bushing 64. The exposed portion of the connector 72 is used to connect the sensor assembly 70 to external equipment, such as external monitoring equipment.

The source conductor assembly 36 also includes a fitting 74 positioned adjacent to the second end 62. The second receptacle 40 of the housing assembly 32 receives the fitting 74. For example, as shown in FIG. 4, the fitting 74 and the second receptacle 40 include mating threads that allow the source conductor assembly 36 to be screwed into the housing assembly 32. A gasket 76 is placed between at least a portion of the fitting 74 and the second receptacle 40 and is compressed when the source conductor assembly 36 is coupled to the housing assembly 32. The gasket 76 prevents moisture and other contaminants from collecting within the fitting 74 and the second receptacle 40 and entering the source conductor assembly 36 or the housing assembly 32. The fitting 74 and the second receptacle 40 can also be configured to form other types of mechanical couplings between the housing assembly 32 and the source conductor assembly 36, such as a snap-fit coupling, a friction coupling, or an adhesive coupling.

Figure 5:
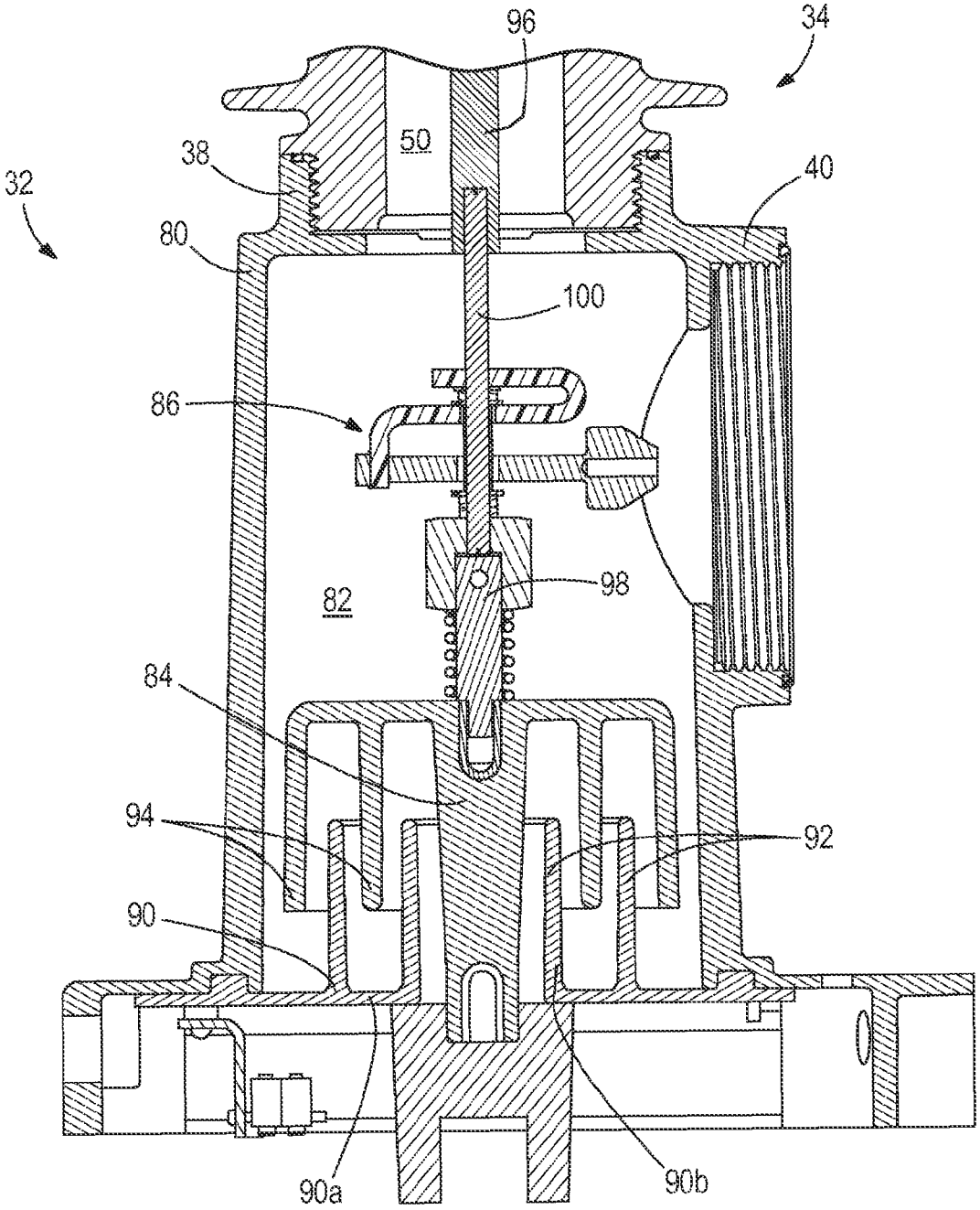
FIG. 5 is a cross-sectional view of a housing assembly of the modular switchgear of FIG. 1.

As shown in FIG. 5, the housing assembly 32 includes a housing 80 that defines a chamber 82. In some embodiments, the first receptacle 38 and the second receptacle 40 can be molded in the housing 80. In other embodiments, the first and second receptacles 38, 40 can be coupled to the housing 80. The housing 80 can be constructed from a plastic material that can withstand high voltage in environmentally polluted areas. Using a plastic material rather than a metal material for the housing assembly 32 allows the housing assembly 32 to be included in creep distance measurements. Therefore, the overall size of the switchgear 30 can be reduced.

The housing assembly 32 includes a drive shaft 84, such as a rod, which is positioned within the chamber 82. The drive shaft 84 interacts with the VI 50 included in the VI assembly 34. In particular, the fitting 52 included in the VI assembly 34 is positioned adjacent an opening in the bushing 46 that allows the drive shaft 84 to access and interact with the movable contact of the VI 50. Similarly, the first receptacle 38 is positioned adjacent an opening in the housing assembly 32 that allows the drive shaft 84 to be coupled to the VI 50.

The housing assembly 32 also houses a flexible conductor 86, which is also positioned within the chamber 82 defined by the housing 80. The flexible conductor 86 electrically couples the VI 50 and the source conductor 68. As described in more detail with respect to FIGS. 5-7, the housing assembly 32 can also include other components. In addition, as shown in FIGS. 1 and 2, the housing assembly 32 is mounted on a base 88 that houses additional components of the switchgear 30. For example, the base 88 can house an electromagnetic actuator mechanism, a latching mechanism, and a motion control circuit.

Therefore, as described above, the VI 50 and the source conductor 68 are each molded in separate bushings and are not over-molded within a common housing. Rather, the separately molded VI 50 and source conductor 68 are coupled to the housing assembly 32, which houses the drive shaft 84 and the flexible conductor 86, using the fittings 52, 74 and receptacles 38, 40. This modularity provides manufacturing and design flexibility. For example, using the modular VI assembly 34 and source conductor assembly 36 allows a similar housing assembly 32 to be used for switchgear with different voltage ratings, VI ratings, current transformer requirements, etc. In particular, modular VI assemblies 34 can be created with different VI ratings but with a similar fitting 52 that mates with the first receptacle 38 on the housing assembly 32. This allows the same housing assembly 32 to be used with different VI assemblies 34 (e.g., with different VIs 50). Similarly, modular source conductor assemblies 36 can be created with different source conductors 68, sensor assemblies 70, or both but with a similar fitting 74 that mates with the second receptacle 40 on the housing assembly 32. Also, because the VI 50, source conductor 68, and drive shaft 84 and flexible conductor 86 are not over-molded in a common housing, such as a single epoxy form, any voids forming on individual components does not make the entire switchgear unusable or unsafe. Rather, because the components are separately molded, a component with a void can be replaced and the remaining components can be reused. Furthermore, in some embodiments, the modular VI assembly 34 and/or source conductor assembly 36 are removably coupled to the housing assembly 32, which allows them to be removed and replaced for maintenance purposes or design changes. Similarly, the modular assemblies 34 and 36 can be removed from one housing assembly 32 and installed on a new housing assembly 32 for maintenance or design purposes.

Accordingly, to manufacture the switchgear 30, the VI assembly 34 and the source conductor assembly 36 are created by separately molding the components. For example, to create the VI assembly 34, the VI 50 is placed within a mold and the mold is at least partially filled with an insulating material, such as one of an epoxy or molding compound, which forms the bushing 46 with the skirts 48 and the fitting 52. Similarly, to create the source conductor assembly 36, the source conductor 68 and sensor assembly 70 (and, optionally, the connector 72) are placed within a mold and the mold is at least partially filled with an insulating material, which forms the bushing 64 with the skirts 66 and the fitting 74.

Once the assemblies 34 and 36 are provided, the housing assembly 32 is also provided. Initially, the housing 80 of the housing assembly 32 can be formed using injection molding or other plastic-forming techniques. The housing 80 defines the chamber 82, where the drive shaft 84 and the flexible conductor 86 are positioned. The housing 80 also defines the first receptacle 38 and the second receptacle 40.

After the housing assembly 32 is provided, the VI assembly 34 is coupled to the housing assembly 32 using the fitting 52 of the VI assembly 34 and the first receptacle 38 of the housing assembly 32. As described above, coupling the VI assembly 34 to the housing assembly 32 can include screwing the fitting 52 into the first receptacle 38. As also described above, the gasket 54 can be placed between the fitting 52 and the first receptacle 38 to provide a secure coupling.

The source conductor assembly 36 is also coupled to the housing assembly 32 using the fitting 74 of the source conductor assembly 36 and the second receptacle 40 of the housing assembly 32. Again, as described above, coupling the source conductor assembly 36 to the housing assembly 32 can include screwing the fitting 74 into the second receptacle 40. A gasket 76 can be placed between the fitting 74 and the second receptacle 40 to provide a secure coupling. The housing assembly 32 is also mounted on the base 88, which houses additional components for the switchgear 30. With the VI assembly 34 and the source conductor assembly 36 coupled to the housing assembly 32 and the housing assembly 32 mounted on the base 88, the switchgear 30 can be installed in a high-power distribution system.

FIG. 5 illustrates the housing assembly 32 and the components contained in the housing assembly 32 in more detail. In particular, as shown in FIG. 5, the housing assembly 32 includes the drive shaft 84, the flexible conductor 86, and a creep extender 90 positioned within the chamber 82 defined by the housing 80. The creep extender 90 includes a first portion 90*a* that is coupled to the housing assembly 32 and/or the base 88. The creep extender 90 also includes a second portion 90*b* that is positioned approximately perpendicular to the first portion 90*a* and forms vertical skirts 92. The vertical skirts 92 mimic or correspond to vertical skirts 94 on the drive shaft 84 such that the skirts 92 of the creep extender 90 extend between the skirts 94 on the drive shaft 84 without contacting the skirts 94. Due to this positioning of the skirts 92 and 94, internal creep distance is increased without adding to the overall height of the switchgear 30.

As also shown in FIG. 5, the drive shaft 84 is coupled to a movable contact 96 of the VI 50 via a spring assembly 98 and a stud 100. The drive shaft 84 moves vertically within the chamber 82 with the stroke of the VI 50 but, as noted above, does not come into contact with the creep extender 90, which maintains the needed creep distance.

Figure 6:
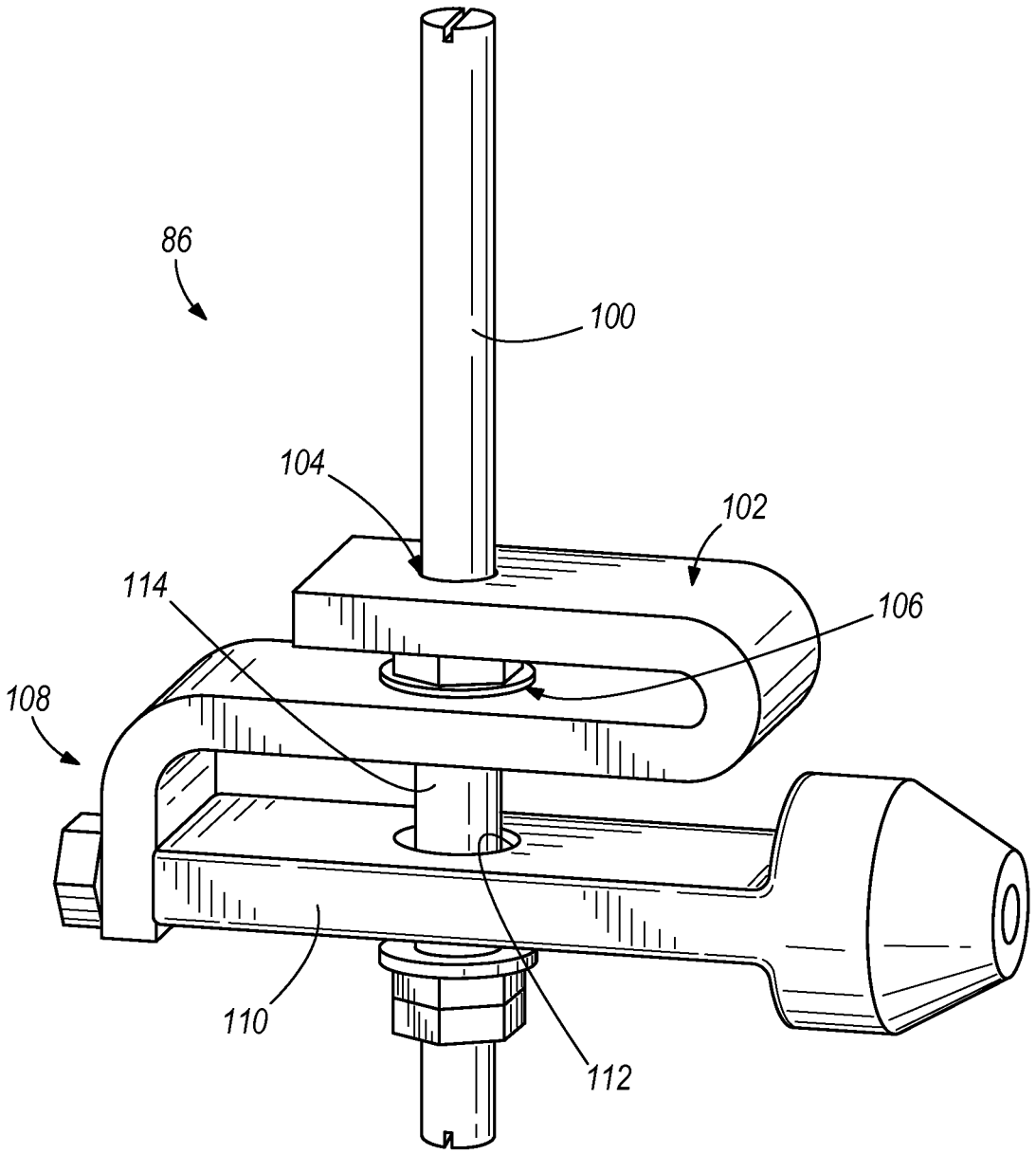
FIG. 6 is a perspective view of a flexible conductor of the modular switchgear of FIG. 1.
Figure 7:
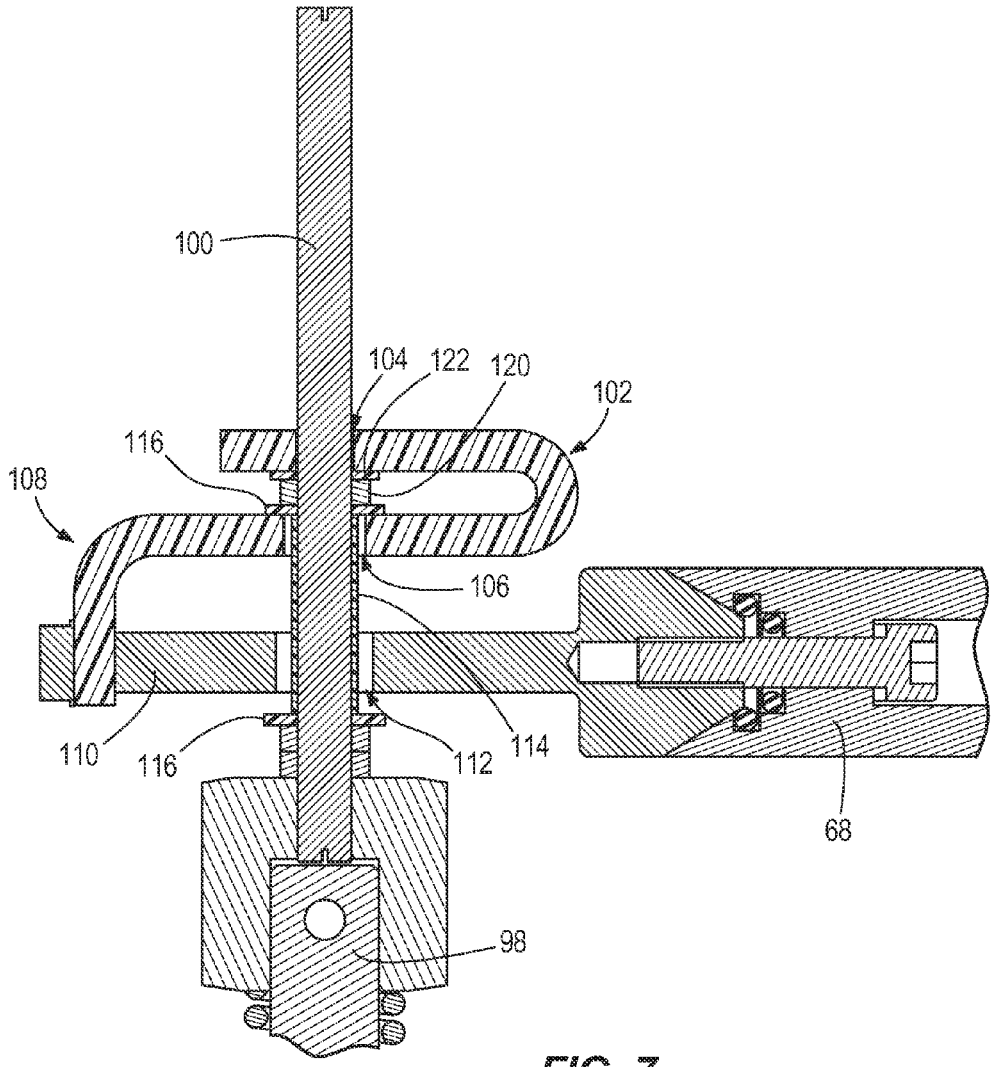
FIG. 7 is a cross-sectional view of the flexible conductor of FIG. 6.

FIGS. 6 and 7 illustrate the flexible conductor 86 in more detail. As shown in FIG. 6, the flexible conductor 86 includes a loop portion 102, which is flexible. The loop portion 102 includes a clearance hole or slot 106 on one side of the loop 102 and a hole 104 on the other side of the loop 102. The flexible conductor 86 is bolted with the movable contact 96 of the VI 50 via the hole 104. A remaining portion 108 of the flexible conductor 86 is also attached to a bus bar 110 that is rigidly attached to the source conductor 68. A clearance hole 112 in the bus bar 110 allows an insulating tube 114 to freely move up and down. The insulating tube 114 is fixed between two insulating washers 116 and over the metal stud 100. The insulating tube 114 prevents electricity conducting from the bus bar 110 and the flexible conductor 86 to pass through the metal stud 100. The insulating washers 116 and the insulating tube 114 provide insulation between the flexible conductor 86 and the metal stud 100, so that all current flows through the loop 102.

Figure 8:
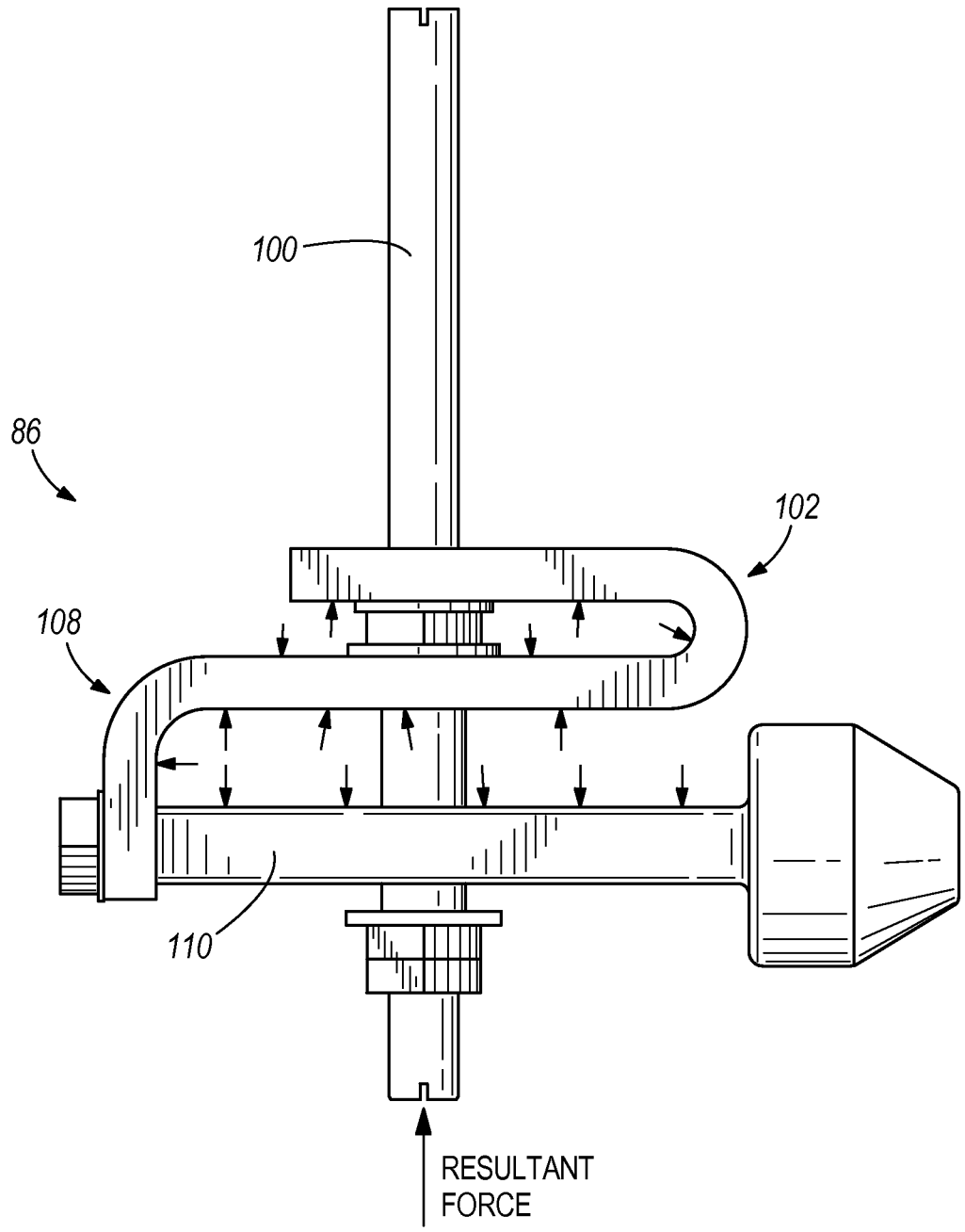
FIG. 8 is a perspective view of the flexible conductor of FIG. 6 illustrating repulsion forces acting on the conductor.

Under normal operations, the flexible conductor 86 is connected in series with the circuit of the switchgear 30. Once the circuit is closed, current flows in and out of the bus bar 110 and the source conductor 68 and also through the flexible conductor 86. The flexible conductor 86 and the bus bar 110 form two reverse loops or paths. A full loop or path is between the bus bar 110 and the entire loop portion 102 of the flexible conductor 86. A half loop or path is between the loop portion 102 of the flexible conductor 86 and the remainder of the assembly 86. The two reverse loops generate repulsion forces due to the electromagnetic field effects generated by the current flowing through the loops, as shown in FIG. 8. These repulsion forces are added to the contact holding force between the movable contact 96 and the stationary contact 97 of the VI 50. Therefore, the mechanical holding force on the movable contact 96 of the VI 50 can be reduced.

In particular, the loop portion 102 causes repelling magnetic forces. The closer the faces of the loop portion 102 are to each other, the greater the forces. For example, the repulsion forces from the full loop acts on a washer (e.g., a Belleville washer) 122 and a jam nut 120 because the bus bar 110 is fixed. This force is symmetric around the movable contact 96 of the VI 50. The repulsion force from the half loop acts directly on the movable contact 96. The repulsion force from a current reverse loop is inversely proportional to the separation distance between the two currents running in opposite directions. The smaller the distance is, the higher the repulsion force. The flexible conductor 86 provides a minimum distance to the half loop using the thin jam nut 120. For the full loop, the separation distance is designed to be the stroke of the VI 50. This design ensures not only a minimal distance for the full loop, but also makes a laminated flexible loop 102 act as a damper during an open circuit.

Figure 9:
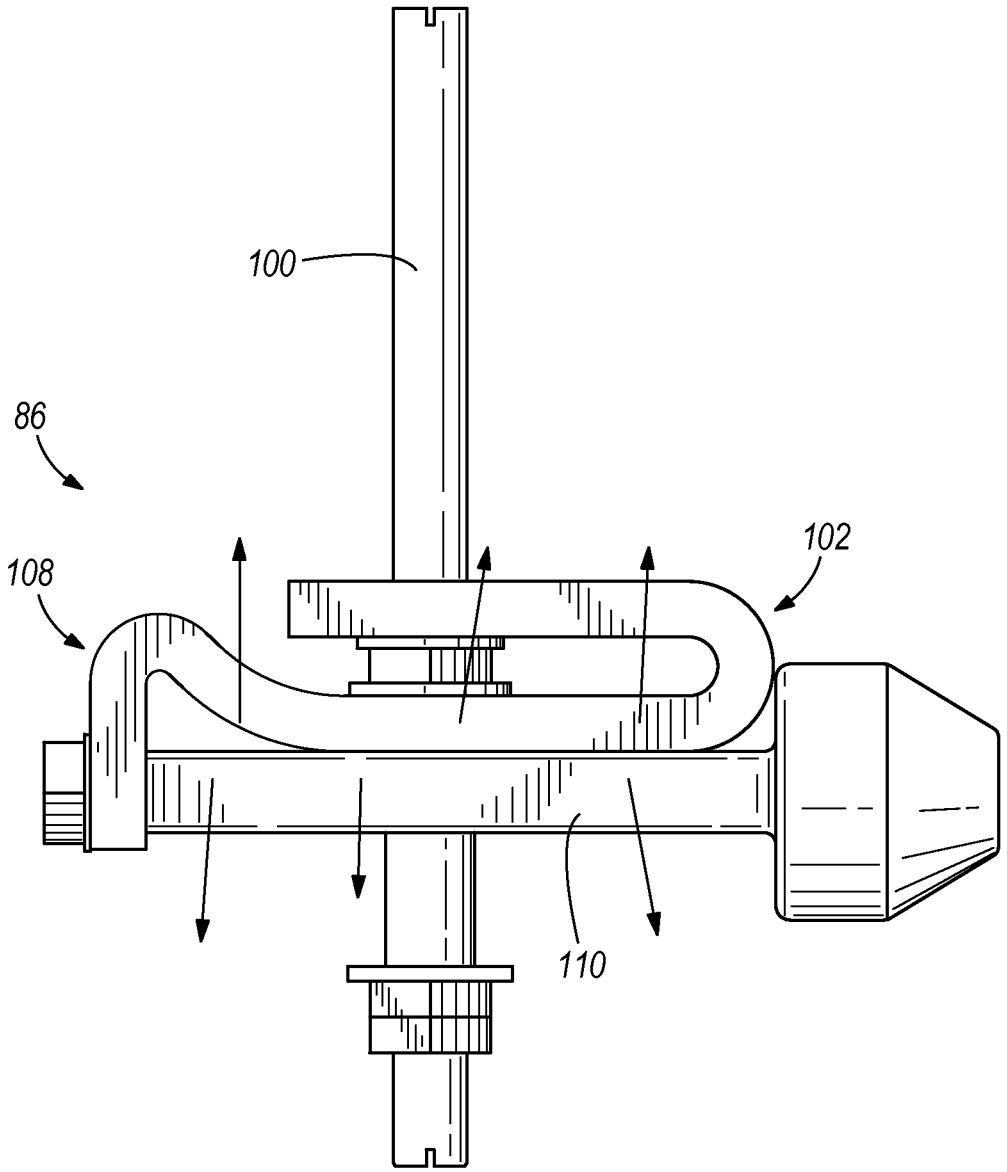
FIG. 9 is a perspective view of the flexible conductor FIG. 6 illustrating the conductor acting as a damper.

In particular, a laminated flexible loop 102 is typically thicker in a free state than in a compressed state (when the thickness is squeezed to its minimum). During opening of the VI 50, the movable contact 96 is pulled by opening springs to separate the contacts. In this situation, as shown in FIG. 9, the main portion of the flexible loop 102 flexes and moves closer to the bus bar 110, which is fixed and static. As the flexible loop 102 is moving toward the bus bar 110, the outermost lamination touches the bus bar 110 first while the rest of the lamination is squeezed to its minimum thickness. Since the bus bar 110 is fixed, the lamination compresses to the bus bar 110 as the metal stud 100 goes through the clearance hole 112 in the bus bar 110. Therefore, the moving kinetic energy of the switchgear is gradually absorbed by squeezing the laminated flexible loop 102, which acts as a damper.

Figure 10:
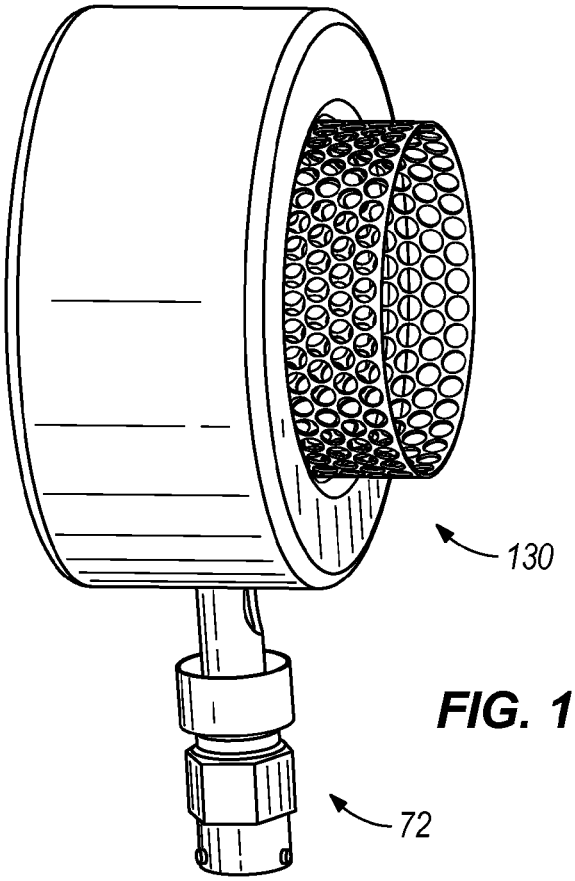
FIG. 10 is a perspective view of a connector for a current transformer of the modular switchgear of FIG. 1.
Figure 11:
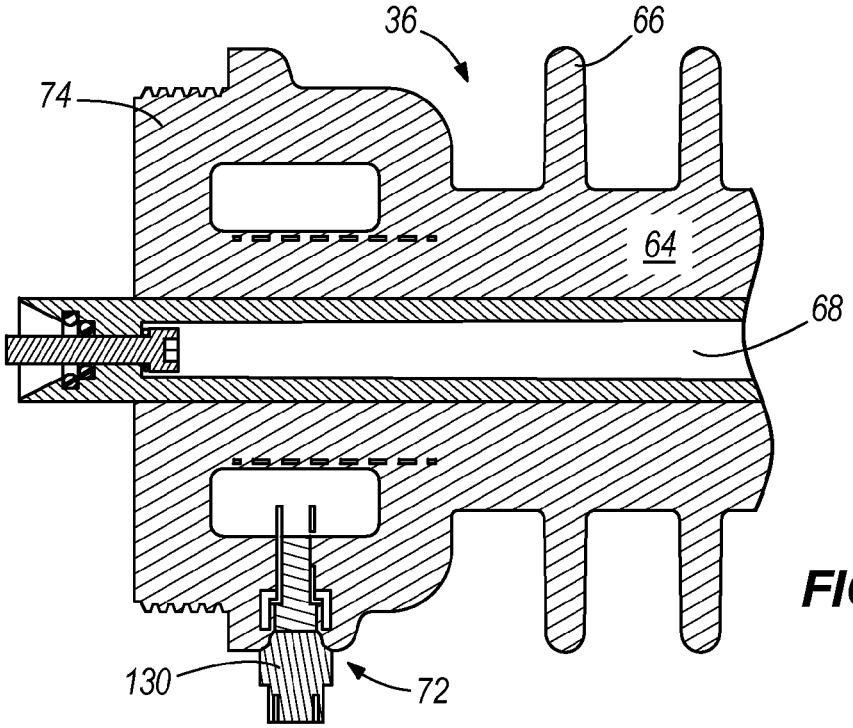
FIG. 11 is a cross-sectional view of the connector of FIG. 10.

As noted above, the source conductor assembly 36 can include a sensor assembly 70 (e.g., including a current transformer). The sensor assembly 70 can be molded into the source conductor assembly 36 and can be grounded via an internal ground wire. To connect the sensor assembly 70 to external equipment, a connector 72 can be coupled to the sensor assembly 70. FIG. 10 illustrates a connector 72 according to one embodiment of the invention. The connector 72 is molded in the source conductor assembly 36 but includes a receptacle 130 that is exposed outside the bushing 64 (see FIG. 11). The exposed receptacle 130 is used to connect the sensor assembly 70 to external equipment, such as external monitoring equipment.

Accordingly, the modular switchgear 30 allows for smaller, more flexible, and more cost-effective switchgear. Also, is should be understood that individual features of the design may be used separately and in various combinations. For example, the connector 72 with the exposed receptacle 130 can be used with switchgear of another design where a sensor is included in the switchgear, such as integrated switchgear described in the background section above. Also, in some embodiments, a modular VI assembly 34 can be used without a modular source conductor assembly 36 or vice versa to provide various levels of flexibility and modularity. For example, if a modular VI assembly 34 is not used, the components included in the VI assembly 34 can be housed within the housing assembly 32 or integrated with other switchgear components. Similarly, if a modular source conductor assembly 36 is not used, the components included in the source conductor assembly 36 can be housed within the housing assembly 32 or integrated with other switchgear components. Also, the modular bushings 34 and 36 can be used without using a housing assembly 32 made of plastic and/or used without a creep extender 90. Similarly, the plastic housing assembly 32 and/or the creep extender 90 can be used without one or both of the modular assemblies 34, 36. Furthermore, the flexible conductor 86 described above can be used in any type of switchgear and is not limited to being used in the switchgear 30 described and illustrated above. Also, a non-flexible conductor 86 can be used with the modular assemblies 34, 36.

Various features and advantages of the invention are set forth in the following claims.

What is claimed is:

1. Modular switchgear comprising:

a vacuum interrupter assembly having a first end and a second end, a bushing, a vacuum interrupter including a movable contact and a stationary contact, the vacuum interrupter molded at least partially within the bushing, and a fitting positioned adjacent to the second end;

a source conductor assembly having a first end and a second end, a bushing, a source conductor molded at least partially within the bushing, and a fitting positioned adjacent the second end; and a housing assembly including a housing defining a chamber, a drive shaft positioned within the chamber and configured to interact with the movable contact included in the vacuum interrupter, a conductor positioned within the chamber and configured to electrically couple the vacuum interrupter and the source conductor, a first receptacle for receiving the fitting of the vacuum interrupter assembly, and a second receptacle for receiving the fitting of the source conductor assembly, wherein the vacuum interrupter assembly is joined to the housing assembly without any common insulation extending between the vacuum interrupter assembly and the housing assembly, and wherein the stationary contact is disposed outside the housing chamber.

2. The switchgear of claim 1, wherein the fitting of the vacuum interrupter assembly includes threads.

3. The switchgear of claim 2, wherein the first receptacle includes threads mating with the threads included in the fitting of the vacuum interrupter assembly.

4. The switchgear of claim 1, wherein the fitting of the source conductor assembly includes threads.

5. The switchgear of claim 4, wherein the second receptacle includes threads mating with the threads included in the fitting of the source conductor assembly.

6. The switchgear of claim 1, wherein the bushing of the vacuum interrupter assembly includes an epoxy.

7. The switchgear of claim 1, wherein the bushing of the source conductor assembly includes an epoxy.

8. The switchgear of claim 1, further comprising a gasket positioned around at least a portion of the fitting of the vacuum interrupter assembly and the first receptacle.

9. The switchgear of claim 1, further comprising a gasket positioned around at least a portion of the fitting of the source conductor assembly and the second receptacle.

10. The switchgear of claim 1, wherein the source conductor assembly includes a sensor assembly.

11. The switchgear of claim 1, wherein the housing of the housing assembly includes a plastic material.

12. The switchgear of claim 1, wherein the first receptacle of the housing is configured to removably receive a fitting of a second vacuum interrupter, the second vacuum interrupter assembly including a vacuum interrupter having a different rating than the vacuum interrupter included in the first vacuum interrupter assembly.

13. The switchgear of claim 1, wherein the first receptacle receives the fitting of the vacuum interrupter assembly using a press-fit.

14. The switchgear of claim 1, wherein the second receptacle receives the fitting of the source conductor assembly using a press-fit.

15. A method of manufacturing switchgear comprising:

providing a vacuum interrupter assembly including a vacuum interrupter molded within a bushing and a fitting, wherein the vacuum interrupter includes a movable contact and a stationary contact;

providing a source conductor assembly including a source conductor molded within a bushing and including a fitting;

providing a housing assembly including a drive shaft configured to interact with the movable contact, a conductor configured to electrically couple the vacuum interrupter and the source conductor, a first receptacle for receiving the fitting of the vacuum interrupter assembly, and a second receptacle for receiving the fitting of the source conductor assembly;

coupling the vacuum interrupter assembly to the housing assembly using the fitting of the vacuum interrupter assembly and the first receptacle without joining the vacuum interrupter assembly and the housing assembly by any common insulation extending between the vacuum interrupter assembly and the housing assembly; and coupling the source conductor assembly to the housing assembly using the fitting of the source conductor assembly and the second receptacle without joining the source conductor assembly and the housing assembly by any common insulation extending between the source conductor assembly and the housing assembly, wherein the stationary contact is disposed outside the housing assembly.

16. The method of claim 15, wherein providing a vacuum interrupter assembly includes providing a vacuum interrupter assembly including a fitting having threads.

17. The method of claim 16, wherein providing a housing assembly includes providing a housing assembly including a first receptacle having threads mating with the threads of the fitting of the vacuum interrupter assembly.

18. The method of claim 15, wherein providing a source conductor assembly includes providing a source conductor assembly including a fitting having threads.

19. The method of claim 18, wherein providing a housing assembly includes providing a housing assembly including a second receptacle having threads mating with the threads of the fitting of the source conductor assembly.

20. The method of claim 15, wherein providing a vacuum interrupter assembly includes molding the vacuum interrupter in an epoxy, the epoxy forming the bushing and the fitting.

21. The method of claim 15, wherein providing a source conductor interrupter assembly includes molding the source conductor in an epoxy, the epoxy forming the bushing and the fitting.

22. The method of claim 15, further comprising positioning a gasket around at least a portion of the fitting of the vacuum interrupter assembly and the first receptacle.

23. The method of claim 15, further comprising positioning a gasket around at least a portion of the fitting of the source conductor assembly and the second receptacle.

24. The method of claim 15, wherein providing a source conductor assembly includes providing a source conductor assembly including a sensor assembly.

25. The method of claim 15, wherein providing a housing assembly includes providing a housing assembly having a housing including plastic material.

26. The method of claim 15, wherein the first receptacle of the housing is configured to removably receive a fitting of a second vacuum interrupter, the second vacuum interrupter assembly including a vacuum interrupter having a different rating than the vacuum interrupter included in the first vacuum interrupter assembly.

27. The method of claim 15, wherein providing a housing assembly includes providing a housing assembly including a first receptacle for receiving the fitting of the vacuum interrupter assembly using a press-fit.

28. The method of claim 15, wherein providing a housing assembly includes providing a housing assembly including a second receptacle for receiving the fitting of the source conductor assembly using a press-fit.

29. Modular switchgear including a vacuum interrupter assembly having a movable contact and a stationary contact, the switchgear comprising:

a housing assembly including a housing defining a chamber and configured to house a conductor configured to electrically couple a vacuum interrupter and a source conductor, wherein the conductor is joined to the housing assembly without any common insulation extending between the conductor and the housing assembly, and a receptacle for receiving the vacuum interrupter assembly, wherein the movable contact and the stationary contact are disposed outside the housing chamber.

30. The switchgear of claim 29, wherein the receptacle is configured to receive one at a time a first vacuum interrupter assembly including a first vacuum interrupter and a second vacuum interrupter assembly including a second vacuum interrupter, wherein the first vacuum interrupter has a different rating than the second vacuum interrupter.

31. The switchgear of claim 29, wherein the receptacle includes threads mating with threads of the vacuum interrupter assembly.

32. The switchgear of claim 29, wherein the receptacle is formed integrally with the housing.

33. The switchgear of claim 29, further comprising a gasket positioned around at least a portion of the receptacle.

34. The switchgear of claim 29, wherein the housing is plastic.

35. The switchgear of claim 29, wherein the housing assembly includes a drive shaft having vertical skirts.

36. The switchgear of claim 35, wherein the housing assembly includes a creep extender having vertical skirts extending between the vertical skirts of the drive shaft.

37. The switchgear of claim 29, wherein the receptacle is configured to receive the vacuum interrupter using a press-fit.

38. Modular switchgear including a vacuum interrupter assembly having a movable contact and a stationary contact, the switchgear comprising:

a housing assembly including a housing defining a chamber configured to house a conductor configured to electrically couple a vacuum interrupter and a source conductor, a first receptacle for receiving a vacuum interrupter assembly, and a second receptacle for receiving a source conductor assembly, wherein the conductor is joined to at least one of the vacuum interrupter and the source conductor without any common insulation extending between the conductor and the at least one of the vacuum interrupter and the source conductor, and the stationary contact is disposed outside the housing chamber.

39. The switchgear of claim 38, wherein the first receptacle includes threads mating with threads of the vacuum interrupter assembly and the second receptacle includes threads mating with threads of the source conductor assembly.

40. The switchgear of claim 38, further comprising a first gasket positioned around at least a portion of the first receptacle and a second gasket positioned around at least a portion of the second receptacle.

41. The switchgear of claim 38, wherein the housing is plastic.

42. The switchgear of claim 38, wherein the housing assembly includes a drive shaft having vertical skirts.

43. The switchgear of claim 42, wherein the housing assembly includes a creep extender having vertical skirts extending between the vertical skirts of the drive shaft.

44. The switchgear of claim 38, wherein the first receptacle is configured to receive the vacuum interrupter assembly using a press-fit.

45. The switchgear of claim 38, wherein the second receptacle is configured to receive the source conductor assembly using a press-fit.

46. Modular switchgear comprising:

a vacuum interrupter assembly including a vacuum interrupter at least partially molded within a bushing;

a source conductor assembly including a source conductor at least partially molded within a bushing; and a housing assembly including a conductor to electrically couple the vacuum interrupter and the source conductor, wherein the vacuum interrupter assembly and the source conductor assembly are each insulated as independent structures from the housing assembly, the conductor is joined to at least one of the vacuum interrupter assembly and the source conductor assembly without any common insulation extending between the conductor and the at least one of the vacuum interrupter assembly and the source conductor assembly, and the vacuum interrupter is disposed outside the housing assembly.

47. The switchgear of claim 46, wherein there is no space between the vacuum interrupter and the bushing.

48. The switchgear of claim 46, wherein the source conductor assembly is joined to the housing assembly without any common insulation extending between the source conductor and the housing assembly.

49. The switchgear of claim 1, wherein the source conductor assembly is joined to the housing assembly without any common insulation extending between the source conductor assembly and the housing assembly.

50. The switchgear of claim 29, wherein the conductor is joined to at least one of the vacuum interrupter assembly and the source conductor without any common insulation extending between the conductor and the at least one of the vacuum interrupter assembly and the source conductor.

51. The switchgear of claim 29, wherein the source conductor is joined to the housing assembly without any common insulation extending between the source conductor and the housing assembly.

52. The switchgear of claim 38, wherein at least one of the vacuum interrupter assembly and the source conductor assembly is joined to the housing assembly without any common insulation extending between the housing assembly and the at least one of the vacuum interrupter assembly and the source conductor assembly.

53. The switchgear of claim 46, wherein the conductor is joined to the housing assembly without any common insulation extending between the conductor and the housing assembly.

* * * * *